US008109060B1

(12) United States Patent
Motosko

(10) Patent No.: US 8,109,060 B1
(45) Date of Patent: Feb. 7, 2012

(54) STORM SHUTTER

(76) Inventor: Stephen J Motosko, Sarasota, FL (US)

( * ) Notice: Subject to any disclaimer, the term of this patent is extended or adjusted under 35 U.S.C. 154(b) by 0 days.

(21) Appl. No.: 11/592,881

(22) Filed: Nov. 6, 2006

(51) Int. Cl.
*E04C 2/38* (2006.01)

(52) U.S. Cl. ..... 52/656.7; 52/202; 52/DIG. 12; 428/178; 428/182

(58) Field of Classification Search ..... 52/202, 52/203, 656.7, DIG. 12, 798.1, 783.1; 428/182, 428/174, 603, 604, 34, 178, 188
See application file for complete search history.

(56) References Cited

U.S. PATENT DOCUMENTS

| | | | | |
|---|---|---|---|---|
| 3,358,408 | A * | 12/1967 | Cooper, Jr. et al. | 52/202 |
| 4,047,354 | A * | 9/1977 | Sutherland | 52/840 |
| 4,169,181 | A * | 9/1979 | Molari, Jr. | 428/217 |
| 4,590,124 | A * | 5/1986 | Schoenberg | 428/339 |
| 5,345,716 | A | 9/1994 | Caplan | |
| 5,457,921 | A * | 10/1995 | Kostrzecha | 52/202 |
| 6,079,168 | A | 6/2000 | Shaver | |
| 6,613,393 | B1 * | 9/2003 | Rauschnabel et al. | 427/488 |
| 6,675,550 | B1 | 1/2004 | Dlubak | |
| 6,705,054 | B2 * | 3/2004 | Pelton | 52/203 |
| 6,715,245 | B2 | 4/2004 | Lewkowitz | |
| 6,868,642 | B2 | 3/2005 | Madden | |
| 6,959,519 | B2 * | 11/2005 | Adriaansen | 52/537 |
| 6,974,622 | B2 | 12/2005 | Wade | |
| 2003/0159372 | A1 | 8/2003 | Motro | |
| 2006/0179737 | A1 * | 8/2006 | Trundle | 52/202 |

FOREIGN PATENT DOCUMENTS

| | | | |
|---|---|---|---|
| RU | 2070458 | C1 * | 12/1996 |
| SU | 989196 | A * | 1/1983 |

OTHER PUBLICATIONS

Hearn, E.J.: Mechanics of Materials, vol. 1—An Introduction to the Mechanics of Elastic and Plastic Deformation of Solids and Structural Materials (3rd Edition), C3 1997 Elsevier, chapter 4, section 2.*

* cited by examiner

*Primary Examiner* — Brian Glessner
*Assistant Examiner* — Adriana Figueroa
(74) *Attorney, Agent, or Firm* — Gifford, Krass, Sprinkle, Anderson & Citkowski, P.C.

(57) ABSTRACT

A light transmitting storm shutter for protectively covering building portals, windows and the like from hurricane damage. A corrugated polycarbonate panel is formed having lengthwise corrugations, each of which preferably has radiused side margins and a generally flattened central portion offset from a neutral axis of the panel. A central corrugation extending along the centerline of the panel, preferably has a depth in a range of at lest 10% greater than that of the edge corrugations, the central corrugations also preferably have a width in a range of at least 4% less than that of the edge corrugation wherein impact and wind resistance of the panel are enhanced. Impact resistant film bonded to one panel surface preferably adds impact strength and sputter coating one panel surface with a transparent metallic or ceramic material enhances solar and UV rejection.

11 Claims, 3 Drawing Sheets

STORM SHUTTER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to protective window and portal coverings for use during hurricanes and high windstorms and more particularly to a uniquely configured transparent or translucent polycarbonate storm shutter which affords enhanced strength and impact resistance during heavy rains and windstorm conditions, particularly during hurricanes.

2. Description of Related Art

Hurricanes, heavy windstorms and tornado activity can produce winds easily capable of heavy property destruction. Windows and door openings may easily be shattered or destroyed which then leads to more severe wind damage due to the wind entering into the building structure and producing great interior pressure gradients against inside window and door surfaces as well as uplifting of the roofing structure which will rapidly to total building destruction. Therefore, initially protecting damage to these windows and portals during such severe storms may mean the difference between saving the entire building and a total loss of such buildings.

One well known method or technique for preventing window and door damage is to temporarily barricade them over with plywood material. However, the plywood should be removed promptly after storm conditions subside because the interior of the building is left completely light-blocked. Moreover, plywood is extremely heavy and difficult to deal with and the deployment and removal typically becomes a major task best left to a contractor.

U.S. Pat. No. 4,333,271 to DePaolo, et al. discloses a metal panel for door and window openings and Kostrzecha teaches a corrugated panel constructed from shatter-resistant and transparent plastic material in U.S. Pat. No. 5,457,921.

A method for adhering a flexible sheet to a polycarbonate sheet is taught by Sofie, et al. in U.S. Pat. No. 5,851,637. A storm panel formed of a film material in the form of two laminated sheets is taught by Motro in published U.S. Application 2003/0159372.

A penetration resistant window including a penetration layer sandwiched between transparent sheets is disclosed in U.S. Pat. No. 6,675,550 to Dlubak. Lewkowitz discloses an impact resistant glass and plastic pane attached to a flexible plastic sheet in U.S. Pat. No. 6,71,245 and Madden teaches a light transmitting storm shutter of corrugated aluminum and clear polycarbonate panels in U.S. Pat. No. 6,868,642.

A segmented storm shutter is taught in U.S. Pat. No. 5,345,716 to Caplan and Shaver discloses a partially transparent storm shutter of polycarbonate plastic sheet material in U.S. Pat. No. 6,079,168. Wade discloses plastic sheets have corrugated regions mounted on tracks in U.S. Pat. No. 6,974,622.

Reusable hurricane window film protection is taught in U.S. Pat. No. 6,705,054 to Pelton and Schoenberg discloses three-layered thermoplastic storm window film in U.S. Pat. No. 4,590,124.

The present invention provides a uniquely configured polycarbonate storm shutter which is easily deployable due to the light weight nature of the transparent or translucent panels and which affords by the nature of the corrugation, enhanced resistance to storm, wind and blown object impact. The preferred embodiment of the invention also includes an additional protective film attached thereto for added strength and may further or alternately include a sputter coated transparent metal or ceramic surface which greatly reduces ultraviolet and solar energy conveyance when the shutters are left in place for longer periods than simply the time period of a single hurricane or storm.

BRIEF SUMMARY OF THE INVENTION

This invention is directed to a transparent or translucent storm shutter for protectively covering a building portal, window and the like from hurricane and storm damage. A corrugated light transmitting polycarbonate panel is formed having continuous adjacent corrugation extending therealong. Each of the corrugations preferably has radiused side margins and a generally flattened or raised central portion offset from a neutral place of the panel. A central one of the corrugations extending along or adjacent to a centerline of the panel, preferably has a depth in a range of at least 10% greater than that of the edge corrugation of the panel, the central corrugations also preferably have a width in a range of at least 4% less than that of the edge corrugation wherein impact and wind resistance of the panel are enhanced. Protective transparent impact resistant film bonded to one panel surface preferably adds impact strength to the panel while sputter coating one panel surface with a transparent metallic or ceramic material enhances solar and UV rejection.

It is therefore an object of this invention to provide a translucent or transparent storm shutter for protectively covering building portals, windows and the like from hurricane and storm damage protection.

Yet another object of this invention is to provide a storm shutter for protecting a building from window or door damage which is formed of polycarbonate sheet material having a unique configuration for added impact resistance strength.

Yet another object of this invention is to provide a storm shutter having a uniquely configured corrugation structure and which may include a transparent hurricane-type film attached thereto for added strength.

Still another object of this invention is to provide a storm shutter formed of corrugated polycarbonate sheet material which may include a sputter coated ceramic or metallic surface layer for added solar and UV energy rejection when the panels are left onto the building while still allowing light to enter there into.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 2:
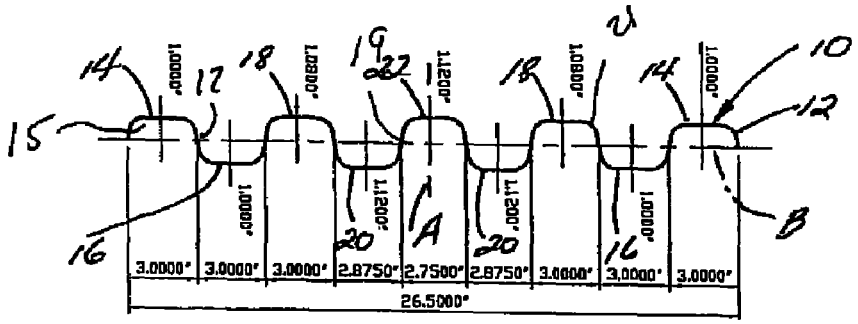
FIG. 2 is an end elevation view of FIG. 1.
Figure 1:
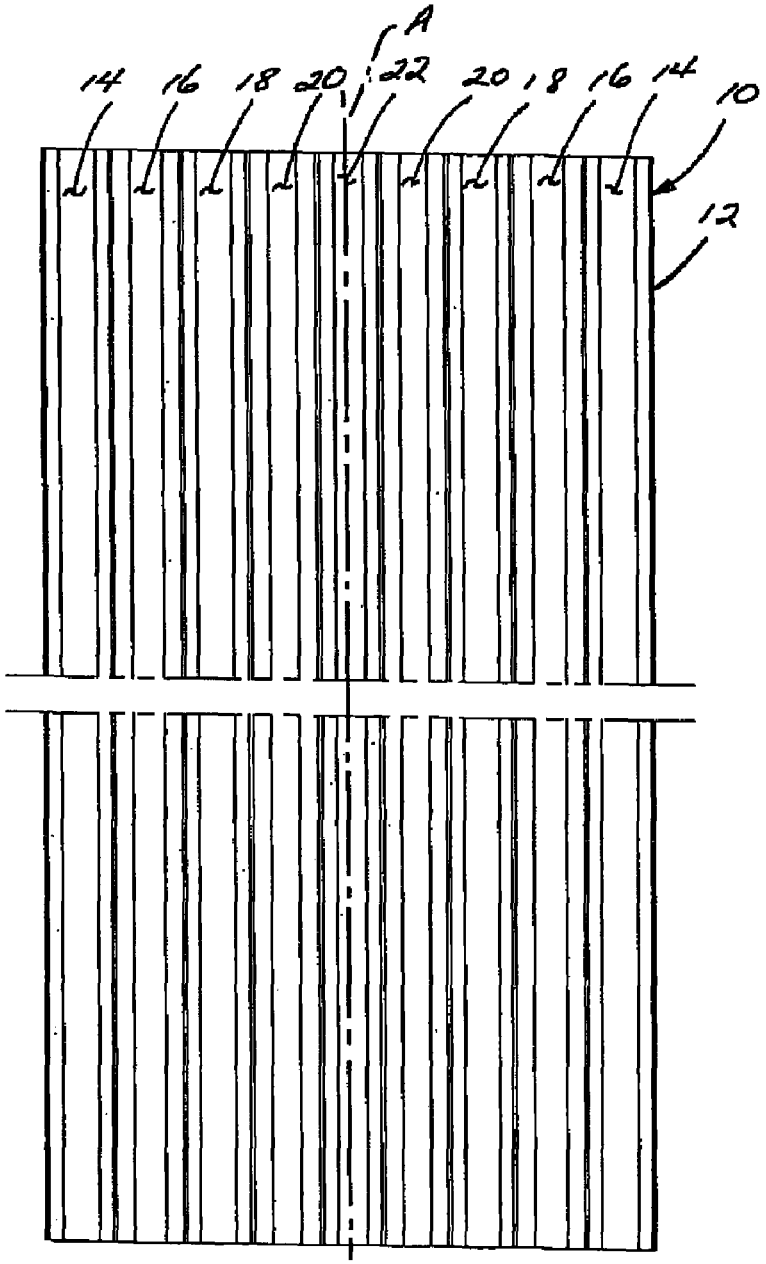
FIG. 1 is a front elevation view of one embodiment of the invention.
Figure 3:
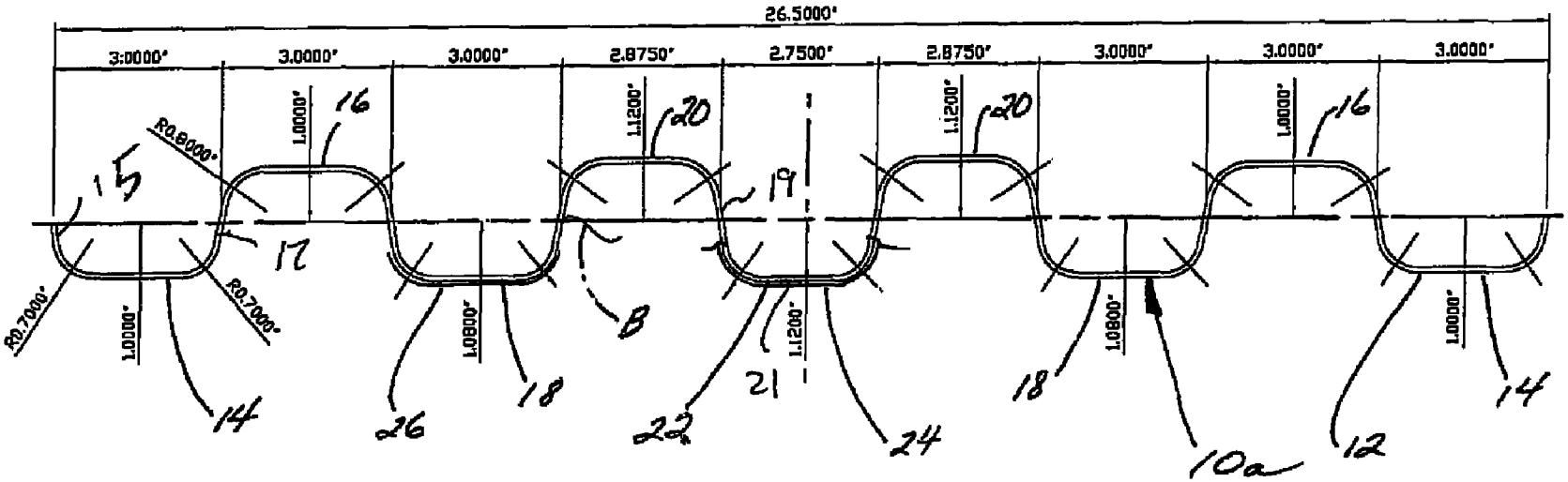
FIG. 3 is an enlarged end elevation view of another embodiment of the invention.

Referring now to the drawings, one embodiment of the invention is there shown generally at numeral 10 in FIGS. 1 and 2. In this embodiment of the storm shutter 10, a corrugated transparent or translucent polycarbonate panel 12 is formed having preferably continuous adjacent corrugations 14, 16, 18, 20 and 22 extending along the entire length of the panel 12. However, overlapping of individual edge corrugations 14 and 16 for expanded width is envisioned. As best seen in FIG. 3, which includes the same corrugated panel 12 as shown in FIGS. 1 and 2, the corrugations 14 along the side margins 15, 17, 19 have a width of 3.000" which is the greatest width of any of the corrugations. Corrugations 16 and 18 also has a corrugation width of 3.000 while the corrugations 20 are decreased in width to 2.875" while the central corrugation 22 has the narrowest width of 2.75".

The height of edge corrugations 14 is established at 1.00" from the neutral plane B to a lateral portion 21 as are corrugations 16, while the corrugations 18 have a height or depth of 1.08", corrugations 20 having a height from the neutral plane B of 1.12" as does the central corrugation 22. These numerical results of corrugation height from the neutral plane and overall width with percentage comparisons are set forth in Table 1 herebelow.

TABLE 1

| Corrugation | Width (in.) | % Change | Depth (in.) | % Change |
|---|---|---|---|---|
| 14 | 3.000 | 0 | 1.000 | 0 |
| 16 | 3.000 | 0 | 1.000 | 0 |
| 18 | 3.000 | 0 | 1.080 | +8% |
| 20 | 2.875 | −4% | 1.120 | +12% |
| 22 | 2.750 | −8% | 1.120 | +12% |

By this arrangement, the central corrugation 22, by virtue of its greatest depth of 1.10 from the neutral plane B and the greatest width, 2.750, affords the greatest resistance to impact against the panel 12, that strength ratio gradually decreasing to the edge corrugations 14. Further, the configuration of each of the corrugations affords added strength in that the central segment of each is flattened over a substantial width thereof which positions that material portion of the panel at the greatest distance from the neutral plane B for maximized strength.

To further enhance the strength characteristics of these panels 12, it is preferred that a layer of transparent impact resistant film 24 be adhered to one of the surfaces of the panel 12. These protective adhesively attached films are of uniform thickness and are well known in this industry. Such films are described in the prior art contained hereinabove. Because the surfaces of the polycarbonate panels 12 are not polished and free of manufacturing defects, it is preferred that they be treated with a plasma open air coating such as that as provided by PLASMATREAT of North America, Inc. located in Missagaua, Ontario, Canada under the trade name FLUME Plasma Systems This plasma system utilizes compressed air and power to generate atmospheric pressure plasma which is blasted onto the surface of the polycarbonate sheet 12 to prepare it for bonding application of the impact resistant film.

Figure 4:
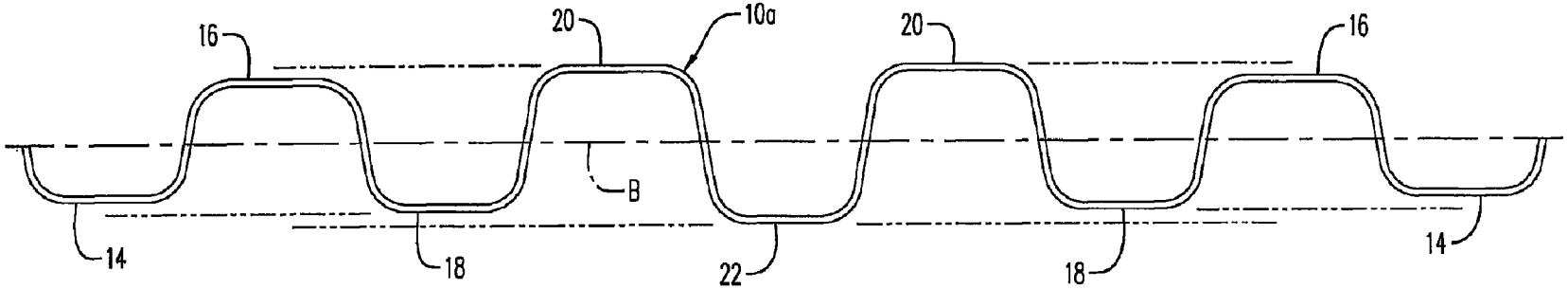
FIG. 4 is a simplified view of FIG. 1.

Referring lastly to FIG. 4, a simplified and clarified embodiment of the invention is there shown generally at numeral 10*a* and is substantially similar to that shown in FIG. 2. This corrugated panel 10*a* is defined as having an imaginary neutral plane B passing through and establishing the boundaries of each of the corrugations 14, 16, 18, 20 and 22. The center valley corrugation 22 has the greatest depth (1.12") from the neutral plane B while each of the peak corrugations 20 adjacent to the center corrugation 22 extend this same maximum distance or height (1.12") from the neutral axis B as does the valley corrugation 22. The next valley corrugations 18 further out from the center of the panel 10*a* have a smaller depth or distance (1.08") from the neutral plane B while the next furthest from the center, peak corrugations 16, have a yet smaller height (1.00") from the neutral plane B than that of the valley corrugations 18. The edge valley corrugations 14 are also smallest in height (1.00") from the neutral plane B as highlighted by the phantom lines.

Because the polycarbonate panels 12 of this invention are transparent or translucent, the light transmitability is greatly enhanced over that of solid or opaque plywood. Therefore, leaving these protective panels in place during an entire hurricane season, for example, is not only feasible, but is highly practical. However, to reduce the amount of UV and solar radiation entering into the building through the protected window or portal, an additional coating of metal or ceramic material 26 deposited by the utilization of sputter coating techniques of one of the surfaces of these panels 12 is also preferred. The use of sputter coating for these plastic or polycarbonate panels 12 is also described in the Background hereinabove.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A storm shutter for protectively covering a building window or doorway from hurricane and storm damage comprising:

a corrugated transparent or translucent plastic panel having a plurality of adjacent generally U-shaped corrugations extending therealong, each of said plurality of U-shaped corrugations having a generally planar lateral portion and a side margin portion;

said panel having a neutral plane extending through a center of said side margin portions;

said plurality of corrugations having at least one center corrugation positioned intermediate a pair of edge corrugations, said at least one center corrugation having a predetermined central depth between said lateral portion and said neutral plane, said pair of edge corrugations having a predetermined edge depth between said lateral portion and said neutral plane which is less than said central depth.

2. A storm shutter as set forth in claim 1, further comprising:

a protective, transparent, impact resistant film of uniform thickness and attached to one surface of said panel and having opposed continuous edges conforming in cross-section to said panel and terminating at the panel edges.

3. A storm shutter as set forth in claim 1, further comprising:

a metal or ceramic material deposited by sputter coated onto one surface of said panel for enhanced solar and UV rejection by said panel.

4. A storm shutter for protectively covering a building window or doorway from hurricane and storm damage comprising:

a corrugated plastic panel having a uniform cross-section along a length of said panel and being defined by a plurality of adjacent parallel corrugations extending along the length of said panel;

said panel having a neutral plane also passing through the cross-section and extending along the length of said panel;

each of said corrugations extending from said neutral plane to a peak having a height or a valley having a depth and in alternate side-by-side fashion;

the height of each said peak and the depth of each said valley decreasing from a central one of said corrugations to an edge one of said corrugations wherein impact and wind resistance of said panel is enhanced.

5. A storm shutter as set forth in claim 4, further comprising:

a protective, transparent, impact resistant film of uniform thickness and attached to one surface of said panel and having opposed continuous edges conforming in cross-section to said panel and terminating at the panel edges.

6. A storm shutter as set forth in claim 4, further comprising:

a metal or ceramic material deposited by sputter coated onto one surface of said panel for enhanced solar and UV rejection by said panel.

7. A storm shutter for protectively covering a building window or doorway from hurricane and storm damage comprising:

a corrugated transparent or translucent plastic panel having a plurality of adjacent parallel corrugations extending along a length of said panel;

said panel having a neutral plane extending along the length of said panel;

each of said corrugations extending from said neutral plane to a single peak or to a single valley in alternate side-by-side fashion;

the height of each said peak and the depth of each said valley decreasing from a longitudinal center to each parallel edge of said panel wherein impact and wind resistance of said panel is enhanced.

8. A storm shutter as set forth in claim 7, further comprising:

a protective, transparent, impact resistant film of uniform thickness and attached to one surface of said panel and having opposed continuous edges conforming in cross-section to said panel and terminating at the panel edges.

9. A storm shutter as set forth in claim 7, further comprising:

a metal or ceramic material deposited by sputter coated onto one surface of said panel for enhanced solar and UV rejection by said panel.

10. The storm shutter as set forth in claim 1, wherein each of said plurality of corrugations have a width between adjacent side margin portions and wherein said width of said center corrugation is less than said width of said pair of edge corrugation side margin portions.

11. The storm shutter of claim 10, wherein each edge corrugation is a pair of corrugations.

* * * * *

UNITED STATES PATENT AND TRADEMARK OFFICE

CERTIFICATE OF CORRECTION

PATENT NO. : 8,109,060 B1
APPLICATION NO. : 11/592881
DATED : February 7, 2012
INVENTOR(S) : Stephen J. Motosko It is certified that error appears in the above-identified patent and that said Letters Patent is hereby corrected as shown below:

At column 1, line number 37, after rapidly, insert --lead--.

At column 2, line number 1, delete “have”, insert --having--.

At column 3, line number 60, after Systems, insert --.--.

Signed and Sealed this
Eighteenth Day of September, 2012

David J. Kappos

David J. Kappos
*Director of the United States Patent and Trademark Office*